United States Patent [19]

Puthon

[11] 4,034,577

[45] July 12, 1977

[54] METHOD OF AND APPARATUS FOR CIRCULAR KNITTING

[75] Inventor: Joseph Puthon, Lyon, France

[73] Assignee: Rhone-Poulenc-Textile, Paris, France

[21] Appl. No.: 597,183

[22] Filed: July 18, 1975

[30] Foreign Application Priority Data

July 18, 1974 France ..... 74.25292

[51] Int. Cl.[2] ..... D04B 35/00

[52] U.S. Cl. ..... 66/1 R

[58] Field of Search ..... 66/1 R, 172 R, 3, 4

[56] References Cited

U.S. PATENT DOCUMENTS

| | | | |
|---|---|---|---|
| 575,760 | 1/1897 | Schmitt | 66/1 R |
| 1,103,589 | 7/1914 | Kellner et al. | 66/172 R |
| 2,072,209 | 3/1937 | Jones | 66/1 R |
| 2,249,081 | 7/1941 | Hughes | 66/172 R |
| 3,982,409 | 9/1976 | Conroux et al. | 66/1 R |

FOREIGN PATENT DOCUMENTS

| | | | |
|---|---|---|---|
| 712,506 | 9/1941 | Germany | 66/1 R |
| 1,435,255 | 12/1968 | Germany | 66/1 R |
| 2,985 | 5/1895 | United Kingdom | 66/3 |

*Primary Examiner*—Mervin Stein
*Assistant Examiner*—A. M. Falik
*Attorney, Agent, or Firm*—Sherman & Shalloway

[57] ABSTRACT

A method for knitting fabrics without needles by sequentially forming loops in adjacent, parallel yarns with each loop being passed through its immediately preceeding loop. The apparatus includes a looping member which rotates on its own axis adjacent the yarns and traverses along transversely of the path of the yarns to successively engage, loop and release each yarn.

6 Claims, 11 Drawing Figures

METHOD OF AND APPARATUS FOR CIRCULAR KNITTING

BACKGROUND OF THE INVENTION

The present invention relates to the knitting of yarns and is concerned, more particularly, with the knitting of yarns without needles by transverse looping of adjacent yarns.

BRIEF DESCRIPTION OF THE PRIOR ART

Prior knitting methods have employed needles to form interengaging loops in a yarn or yarns to form the knitted fabric. In flat or weft-knitting, a single yarn is looped by each of the needles in succession. In circular knitting, each of the needles is associated with one of a plurality of threads.

The prior knitting machines have been relatively complex and have been prone to recurrent problems of breakage, maladjustment and interruption of their operation. Therefore, it has been quite difficult to associate such machines directly with yarn-forming units without special accomodation for the operational interruptions. This is particularly true, for example, when it is desired to use a knitter in conjunction with a unit for forming artificial or synthetic, continuous filaments.

One of the most frequent problems encountered with knitting machines employing needles is that of needle breakage. The needles are quite costly, in themselves, and the constant maintenance they require add greatly to the cost of the knitting operation. Although many of the components in flat knitting machines are stationary, circular knitters have a large number of moving parts. These units require the rotation of either the yarns being fed to the machine or the body of the knitted fabric. Furthermore, circular knitters typically employ relatively complex, moving needles which are even more prone to breakage because of their delicate components and their exposure to forces or tensions as they move.

Circular knitting machines are quite complex in nature and quite complicated in their operations, requiring continuous attention and frequent servicing and adjustment to keep them operating properly. Since they operate at high speeds, these machines tend to produce substantial quantities of defective fabric is relatively short intervals of improper operation and are, therefore, quite wasteful if they are not closely attended.

Therefore, prior knitting methods and machines have not been found to be entirely satisfactory.

SUMMARY OF THE INVENTION

In general, the preferred knitting method of the present invention comprises feeding a plurality of yarns in parallel relationship to each other and uniformly spaced from each other, forming a loop in a first of the yarns, drawing an adjacent yarn through the first loop and forming a loop in the drawn portion of the adjacent yarn, releasing the first loop while drawing a portion of the next adjacent yarn through the second loop, and forming a loop in the drawn portion of said next adjacent yarn.

The preferred form of apparatus of the present invention comprises means for feeding a plurality of yarns in parallel and uniformly spaced from each other, a looping member mounted for rotation on an axis substantially parallel to the yarns, means for traversing the looping member transversely of the yarns, the looping member including a lateral portion having a hook for engaging each yarn in succession and a storage portion for holding a yarn after it is engaged by the hook and during one revolution of the looping member, and means for synchronizing the rotation of the looping member in relation to its traversing motion to present the hook for engagement of each yarn in succession.

OBJECTS OF THE INVENTION

It is an object of the present invention to provide a method of knitting yarns without needles.

It is a further object of the present invention to provide a simple method for circular knitting without requiring rotation of either the yarn feed or the product fabric.

It is a still further object of the present invention to provide a simple and reliable knitting unit which forms interengaging loops in adjacent yarns without needles.

Another object of the present invention is the provision of a simple and reliable knitting unit which forms interengaging loops in adjacent yarns which are supplied in parallel relationship and uniformly spaced from each other in a circular pattern.

A further object of the present invention is the provision of a simple and reliable knitting unit which forms interengaging loops in adjacent yarns by means of a looping member traversing adjacent the yarns and transversely of the direction of supply of the yarn.

A particular object of the present invention is the provision of a circular knitting unit which forms interengaging loops in succession in adjacent yarns without rotation of either the yarn feed or the product fabric.

A further particular object of the present invention is the provision of a simple and reliable circular knitter having a non-rotating yarn travel and a looping member traversing adjacent the yarn feed and synchronized for timed engagement of each successive yarn.

A more particular object of the present invention is the provision of a simple ad reliable circular knitter having a non-rotating yarn travel and a rotating looping member planetating about the yarn feed and synchronized in its rotation to engage each successive yarn in the yarn feed to form transverse, interengaging loops in adjacent yarns.

Another particular object of the present invention is the provision of a rotating looping member for knitting machines and including a curved lateral portion tapering toward and terminating in a yarn-engaging hook, and a shank portion having a timing member for timing the rotation of the looping member to engage successive yarns to form single-twist, interengaging loops in adjacent yarns.

A further particular object of the present invention is the provision of a knitted fabric comprising adjacent longitudinal yarns which engage each other by means of transverse single-twist loops generally at ring angles to the longitudinal direction of the yarns.

BRIEF DESCRIPTION OF THE DRAWINGS

These and other objects of the invention and a better understanding thereof may be derived from the following description and the accompanying drawings, in which.

DETAILED DESCRIPTION OF THE PREFERRED EMBODIMENT

Figure 1:
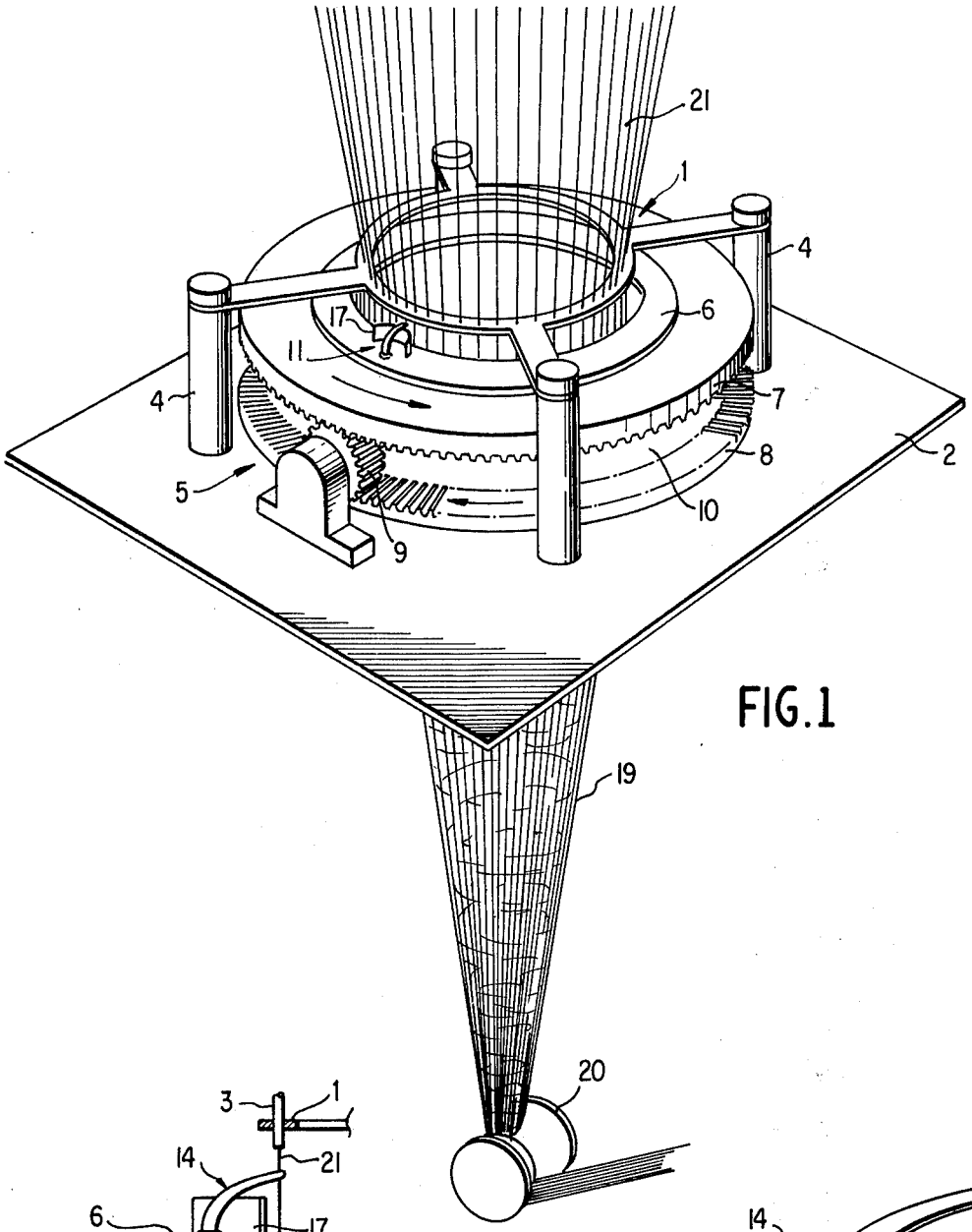
FIG. 1 is a perspective view of the preferred form of circular knitter according to the invention.
Figure 2:
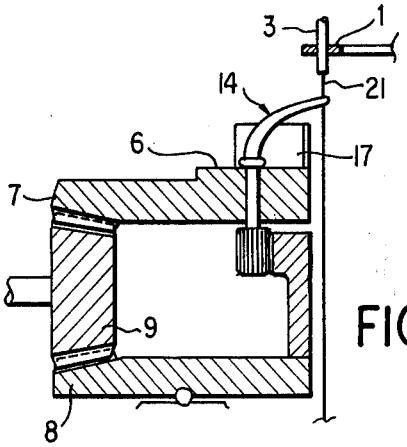
FIG. 2 is a side view, partly cut away, of a portion of FIG. 1.
Figure 3:
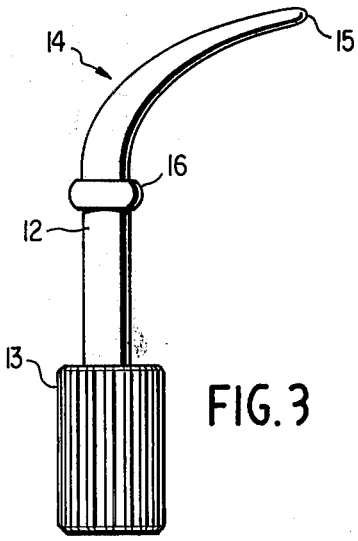
FIG. 3 is a side view, on an enlarged scale, of the looping member.

As best shown in FIGS. 1 through 3, the preferred form of knitting unit according to the invention comprises a yarn guide 1 mounted on a base plate 2 and having a plurality of parallel, uniformly spaced guide sleeves 3 distributed in a circular pattern. The yarn guide is supported clear of the base plate by posts 4 to provide clearance for an annular knitter 5. The knitter 5 includes an annular knitting plate 6 mounted on the upper bevel gear 7 which is driven, along with a lower bevel gear 8, by a pinion gear 9 which, in turn, is driven by any suitable means (not shown).

The knitting plate 6 carries a looping or knitting member 11 mounted for rotation thereon. The looping member 11 includes a shank portion 12 which terminates in a gear member 13, below the plate 6, and a lateral portion 14 which tapers toward and terminates in a hook 15. Any suitable means, such as the shoulder 16 shown, may be used to support the looping member on the plate 6, although it should be understood that the member 11 rotates with respect to the plate 6, so that friction therebetween should be kept to a minimum.

The gear portion 13 of the looping member meshes with a circumferential gear band 10 which is mounted on and driven by the lower bevel gear 8. The looping member, therefore, is rotated on the axis of its shank 12, which axis most advantageously is parallel to the direction of supply of the yarns from the guide sleeves to the knitting zone. The lateral portion is dimensioned such that the hook 15 passes beneath the yarn sleeves 3 during a part of its rotation, as will be discussed more fully hereinafter.

The plate 6 carried a curved flange 17 intermediate the looping member 11 and the zone of the guide sleeves 3 which, in turn, has a smooth notch 18 on its upper edge at or adjacent the point at which the hook 15 crosses the upper edge after rotating away from the area of the guide sleeves 3.

The system is tensioned, via the product fabric 19, by means of tensioning rolls 20. The fabric is then removed, by any suitable means, to storage or further treatment.

It is to be understood that the knitting unit of the present invention may be installed as desired, including an association with yarn-forming apparatus, within a dyeing system including location within the dyebath itself, or in any desired location. Also, it is to be understood that the particular means by which yarn is supplied is not critical to the invention.

OPERATION OF THE PREFERRED EMBODIMENT

In operation, driving of the pinion 9 causes the upper and lower bevel gears 7 and 8 to rotate in opposite directions, as indicated by the arrows. Accordingly, the upper bevel gear rotates counterclockwise, as viewed from the top of FIG. 1, and carries the plate 6 and the looping member 11 in the same direction.

However, while it planetates or orbits about the yarn zone, the looping member, by reason of the gear portion 13 meshing with the clockwise-rotating peripheral gear 10, is driven at a substantial rotational speed with respect to the plate 6, also counter-clockwise when viewed from the top of FIG. 1.

Figure 4:
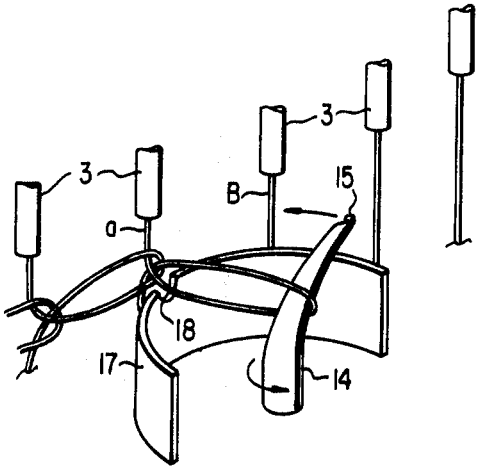
FIGS. 4 through 9 are successive views, on an enlarged scale, showing the several stages of loop formation.

Accordingly, the looping member 11 rotates through the sequence shown in FIGS. 4 through 9, including:

In FIG. 4, the curved lateral portion 14 carries a loop of a first yarn "A" while the hook 15 approaches the adjacent yarn "B."

Figure 5:
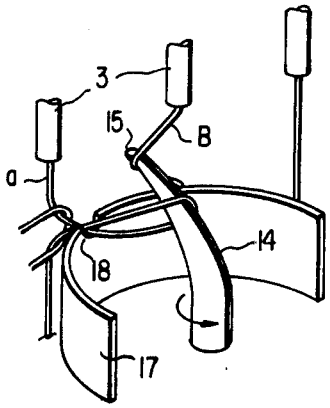

In FIG. 5, continued rotation of the looping member 11 has drawn a portion of the yarn B and is allowing the loop formed in yarn A to slip toward the end of the lateral portion.

Figure 6:
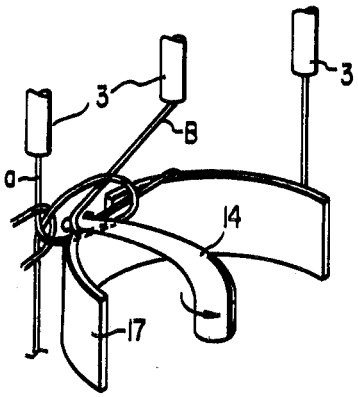

In FIG. 6, the drawn portion of yarn B has been pulled through the loop of yarn A, which is then free of the lateral portion but still engaged by the drawn portion of the yarn B.

Figure 7:
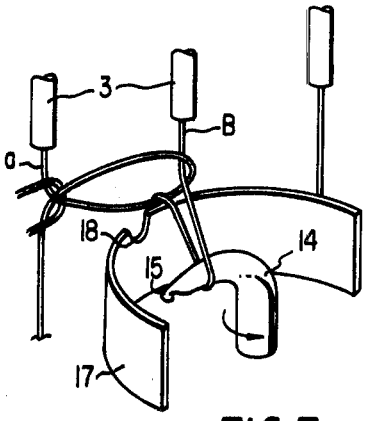

In FIG. 7, the drawn portion of yarn B has passed from the hook 15 and is passing downward along the curve of the lateral portion 14.

Figure 8:
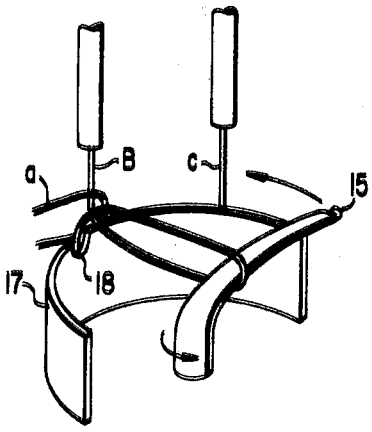
Figure 7A:
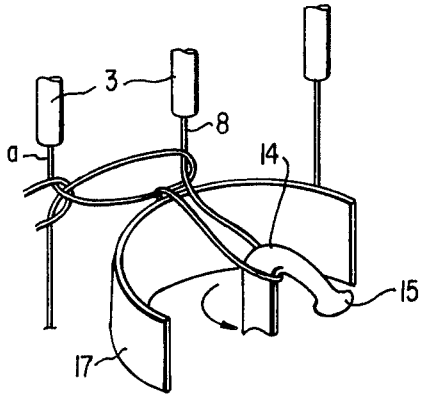

FIG. 7*a* shows the drawn portion of yarn B as it is about to be twisted into a loop, with the hook 15 intermediate to the positions seen in FIGS. 7 and 8.

In FIG. 8, the drawn portion of yarn B has now twisted into a loop, while the hook 15 is approaching the next yarn C.

As is seen in FIGS. 4, 5, 7, 8 and 9, the drawn portion of the yarn B remains of the lateral portion 14 of the looping member 11.

Figure 9:
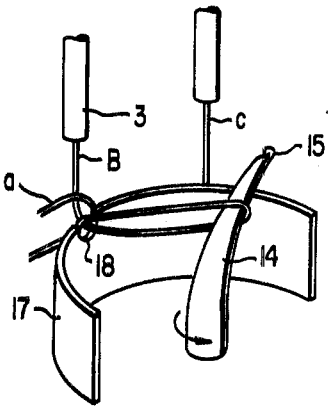

In FIG. 9, the member 11 has rotated close to the position shown in FIG. 4, so that the sequence will be then repeated by drawing a portion of the yarn C through the loop in yarn B, and repeating the sequence with each of the yarns in the ring of sleeves 3.

Figure 10:
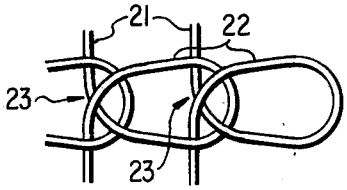
FIG. 10 is an enlarged view of a portion of the knitted product of the present invention and showing the characteristic interengagement of the yarns.

The nature of the product fabric may best be understood with reference to FIG. 10. The yarns 21 extend generally longitudinally but, by reason of the interengagement of their transverse loops 22 at the twist 23 of the adjacent loops they are knitted in a secure manner which all but precludes unintentional de-knitting or unravelling.

EXAMPLE

A knitter in accordance with FIG. 1 was provided with three looping members spaced at 120° intervals about the knitter plate.

The yarn supplied was a polyamide comprising 30 of gauge 235 dtex/34, formed of poly(hexamethylene-adipamide). The yarns were spaced a uniform distance of 5mm from each other at the guide sleeves and were fed to the system at a rate of 4 meters/min.

The speed of rotation of the looping members 11 was 3,600 rpm (about its own axis) while the speed of the bevel gears was 120 rpm.

The fabric obtained has the stitch construction shown in FIG. 10 and can be used for temporarily storing yarn instead of winding the yarn on bobbins.

Therefore, it is apparent that the present invention provides an especially advantageous new method and apparatus for the knitting of yarns, whether the new knitted product is the final product or is to be de-knit subsequently.

It has been found that the present invention is not limited to a given size or to any particular type of yarn. The yarn may be of any type of gauge, whether spun, extruded or otherwise produced. Similarly, the yarns may be stretched, partly stretched or unstretched and may be plain or crimped, as desired.

The nature of the knit produced may be varied by changes in the tension applied, the rate of rotation of the knitter and of the looping member, or all of them. The looping member may operate at speeds of 4,000 to 5,000 rpm about its own axis and can produce knitted fabric at the rate of up to 8 to 10 meters/min. For high knitting rates, multiple looping members are advantageous and do not complicate the system, since they are self-starting in operation as soon as they engage the first yarn. These looping members may be either solid or hollow, as desired, and may be driven by any suitable means.

The present invention may also be applied to the production of non-uniform fabrics by random orientation of the yarns and may be used with any desired number of yarns in either the preferred circular arrangement or in another arrangement such as a flat or straight-line course, with appropriate change in the drive mechanism and traverse mechanism for the looping member.

Various changes may be made in the details of the invention, as disclosed, without sacrificing the advantages thereof of departing the scope of the appended claims.

What is claimed is:

1. Knitting apparatus comprising a. yarn guide means for guiding a plurality of spaced yarns in circular parallel relationship, b. knitting means including c. a looping member mounted for rotation about its axis having d. a lateral portion and e. a hook f. means for traversing said looping member transversely of and adjacent to said spaced yarns by orbiting the looping member completely around the yarn circle, g. and said knitting means including means for driving said looping member to rotate about said axis thereof to form interengaging single-twist loops in adjacent of said spaced yarn.

2. Knitting apparatus as set forth in claim 1 in which said looping member includes a tapered lateral portion having a yarn-engaging hook

3. Knitting apparatus as set forth in claim 1 in which said looping member is mounted on an annular plate and includes a gear member remote from its lateral portion, and including means for rotating said annular plate about the yarn circle and driven gear means for rotating said looping member with respect to said plate.

4. Knitting apparatus as set forth in claim 3 in which said driven gear means includes a gear member driven in a rotational direction opposite the direction of rotation of said annular plate.

5. Knitting apparatus as set forth in claim 4 in which said annular plate includes a ring gear, said driven gear means includes a second ring gear and a pinion gear engaging both said second ring gear and the ring gear of said annular plate.

6. The method of knitting yarns into a fabric comprising feeding a plurality of yarns in parallel relationship to each other while in a circular array and uniformly spaced from each other;

forming a first loop in a first of said yarns by engaging the yarn and pulling a portion of the yarn toward the interior of the circular array while rotating the loop about an axis substantially parallel to the yarn in the array;

forming a single twist to close the first loop; drawing a portion of an adjacent yarn through the first loop to form a second loop in the same manner as the first loop in the drawn portion of the adjacent yarn;

forming a single twist to close the second loop; releasing the first loop while drawing a portion of the next adjacent yarn through the second loop; forming a loop in the drawn portion of said next adjacent yarn; and repeating the afore-recited steps in succession on each of the said yarns in the circular array to form the fabric comprising interengaging single twist loops in adjacent of said spaced yarns.

* * * * *